US008360561B2

(12) United States Patent
Livshitz et al.

(10) Patent No.: US 8,360,561 B2
(45) Date of Patent: Jan. 29, 2013

(54) SELF-CLEANING INK SUPPLY SYSTEMS

(75) Inventors: Boris Livshitz, Rishon le Zion (IL); Vadim Genkin, Rehovot (IL); Eli Ireni, Ra anana (IL); Benji Ruhm, Tel-Aviv (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 188 days.

(21) Appl. No.: 12/867,014

(22) PCT Filed: Feb. 11, 2008

(86) PCT No.: PCT/US2008/053544

§ 371 (c)(1),
(2), (4) Date: Aug. 10, 2010

(87) PCT Pub. No.: WO2009/102315

PCT Pub. Date: Aug. 20, 2009

(65) Prior Publication Data

US 2010/0328371 A1 Dec. 30, 2010

(51) Int. Cl.
*B41J 2/17* (2006.01)

(52) U.S. Cl. ..... 347/84

(58) Field of Classification Search ..... 347/6, 7, 347/84, 85

See application file for complete search history.

(56) References Cited

U.S. PATENT DOCUMENTS

| | | | | |
|---|---|---|---|---|
| 4,737,801 | A | 4/1988 | Ichihashi et al. | |
| 5,189,438 | A | 2/1993 | Hine et al. | |
| 5,680,165 | A | 10/1997 | Takizawa et al. | |
| 5,793,395 | A * | 8/1998 | Tanaka et al. | 347/85 |
| 5,910,810 | A | 6/1999 | Brooks et al. | |
| 5,992,991 | A | 11/1999 | Kanemoto et al. | |
| 6,428,156 | B1 | 8/2002 | Waller et al. | |
| 6,481,837 | B1 * | 11/2002 | Askren et al. | 347/85 |
| 7,121,652 | B2 | 10/2006 | Harada et al. | |
| 7,249,827 | B2 * | 7/2007 | Shimizu et al. | 347/68 |
| 8,079,693 | B2 * | 12/2011 | Hoshino | 347/92 |
| 2005/0057586 | A1 | 3/2005 | Brenner | |

FOREIGN PATENT DOCUMENTS

| | | |
|---|---|---|
| EP | 0916502 A2 | 5/1999 |
| JP | 7-052398 | 2/1995 |
| JP | 2006-247901 | 9/2006 |
| JP | 2007-276374 | 10/2007 |
| KR | 10-2001-19860 | 3/2001 |
| WO | WO 2007/098527 A1 | 9/2007 |

OTHER PUBLICATIONS

European Search Report for EP Application No. 08729497.1—PCT/US2008/053544 dated Aug. 16, 2011 (8 pages).

International Search Report and Written Opinion for PCT/US2008/053544 dated Sep. 16, 2008 (10 pages).

* cited by examiner

*Primary Examiner* — An Do

(57) ABSTRACT

In one embodiment, a method for controlling an ink supply system includes operating a pump of the ink supply system in a forward direction to supply ink from an ink reservoir to an ink tank, and subsequent to operating the pump in the forward direction, reversing the pump and operating the pump in a reverse direction to prevent or reduce formation of clogs within the ink supply system.

19 Claims, 6 Drawing Sheets

SELF-CLEANING INK SUPPLY SYSTEMS

BACKGROUND

Printing equipment, such as commercial printing presses, often print using liquid ink. In such cases, the printing equipment includes one or more ink supply systems that provide ink to a printing mechanism of the equipment. Once such ink is received by the printing mechanism, the mechanism applies the ink to a print medium, such as paper.

Several ink supply systems comprise a reservoir in which the ink is stored, one or more tubes that carry ink from the reservoir to the printing mechanism, and some form of pumping mechanism that urges the ink through the tubes. When the printing equipment is operated, ink from the reservoir is supplied to the printing mechanism as needed.

It is not uncommon for clogs to form within one or more of the reservoir, tubes, or pumping mechanism and block delivery of ink to the printing mechanism. When this occurs, the supply system must be cleared. Often, such clearing comprises manual flushing of the system performed by a technician. Although such manual flushing is not necessarily difficult to perform, it is inconvenient and is an inefficient method of maintaining the ink supply system, particularly when clogging occurs on a frequent basis.

BRIEF DESCRIPTION OF THE DRAWINGS

The disclosed systems can be better understood with reference to the following drawings. The components in the drawings are not necessarily to scale.

DETAILED DESCRIPTION

As described above, it is not uncommon for clogs to form within an ink supply system. Although manual flushing can be performed to clear such clogs, such a solution is undesirable. Disclosed in the following are ink supply systems that are capable of cleaning themselves, thereby rendering such manual flushing unnecessary. In some embodiments, the self-cleaning ink supply systems comprise a pump that operates in a forward direction when supplying ink to a printing mechanism and in a reverse direction when self-cleaning. Such reverse operation of the pump breaks apart clogs and/or prevents the clogs from forming in the first place such that the ink path defined by the ink supply system remains clear.

Figure 1:
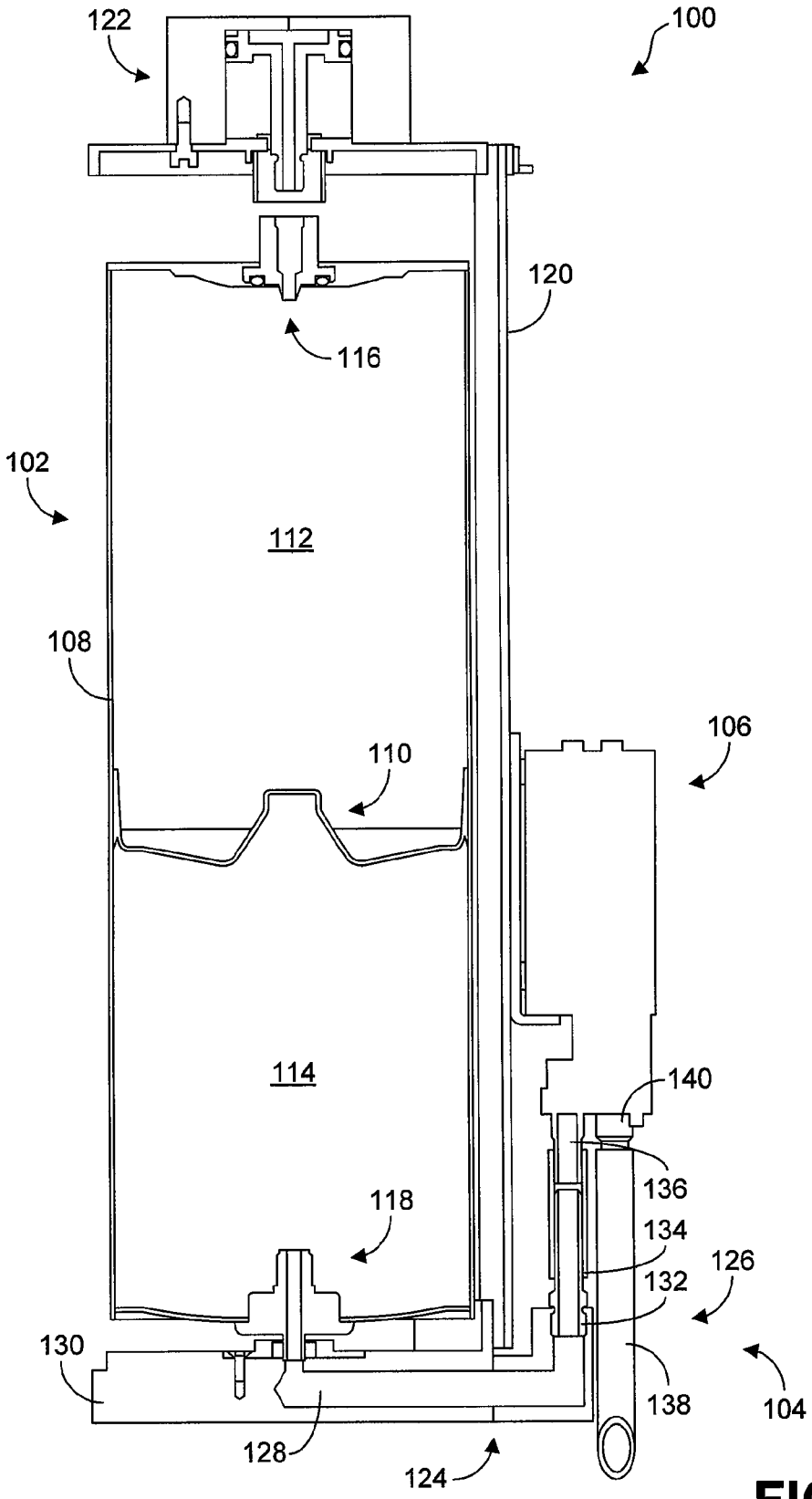
FIG. 1 is a side view of an embodiment of a self-cleaning ink supply system.

Turning to the figures, in which like numerals identify corresponding components, illustrated in FIG. 1 is an embodiment of a self-cleaning ink supply system 100. As indicated in FIG. 1, the ink supply system 100 generally comprises a concentrated ink reservoir 102, a system of ink delivery passages 104, and a pump 106.

In the embodiment of FIG. 1, the concentrated ink reservoir 102 comprises an elongated container 108. By way of example, the container 108 is formed as a metal canister. Within the container 108 is a piston 110 that separates the interior space of the container into two portions. On one side of (e.g., above) the piston 110 is gas 112, such as air. On another side of (e.g., below) the piston 110 is concentrated ink or ink "paste" 114 that is to be supplied by the system 100 to a printing mechanism (not shown). At a first (e.g., top) end of the container 108 is a gas port or inlet 116 and at a second (e.g., bottom) end of the container is an ink outlet port or outlet 118.

Mounted to a support member 120 of the system is a coupler 122 that can be coupled to the gas inlet 116. In the illustrated embodiment, the coupler 122 can be moved downward into firm contact with the gas inlet 116 such that an airtight seal is formed between the coupler and the inlet. In such a configuration, pressurized gas (e.g., air) can be delivered through the gas inlet 116 and into the container 108 so as to pressurize the container and urge the piston 110 against the concentrated ink 114. When the piston 110 is so urged, the concentrated ink 114 is pressurized and therefore may flow through the ink outlet 118 and out of the container 108, when the pump 106 is operated.

With further reference to FIG. 1, the concentrated ink 114 drawn from the container 108 enters the system of ink delivery passages 104. That system 104 includes a first section 124 that extends from the container 108 to the pump 106, and a second section 126 that extends from the pump to an ink tank (not shown) of the ink supply system 100. In the embodiment of FIG. 1, the first section 124 comprises a first passage or tube 128 formed within a support member 130, a second passage or tube 132, and a third passage or tube 134. The first tube 128 is coupled with the ink outlet 118 at a first end and with the second tube 132 at a second end. The second tube 132 is coupled with the first tube 128 at a first end and with the third tube 134 at a second end. Finally, the third tube 134 is coupled with the second tube 132 at a first end and an inlet port 136 of the pump 106 at a second end. The second section 126 of the system of passages 104 comprises a fourth passage or tube 138 that is coupled with an outlet port 140 of the pump 106 at a first end and with an ink tank (not shown) at a second end.

Figure 2A:
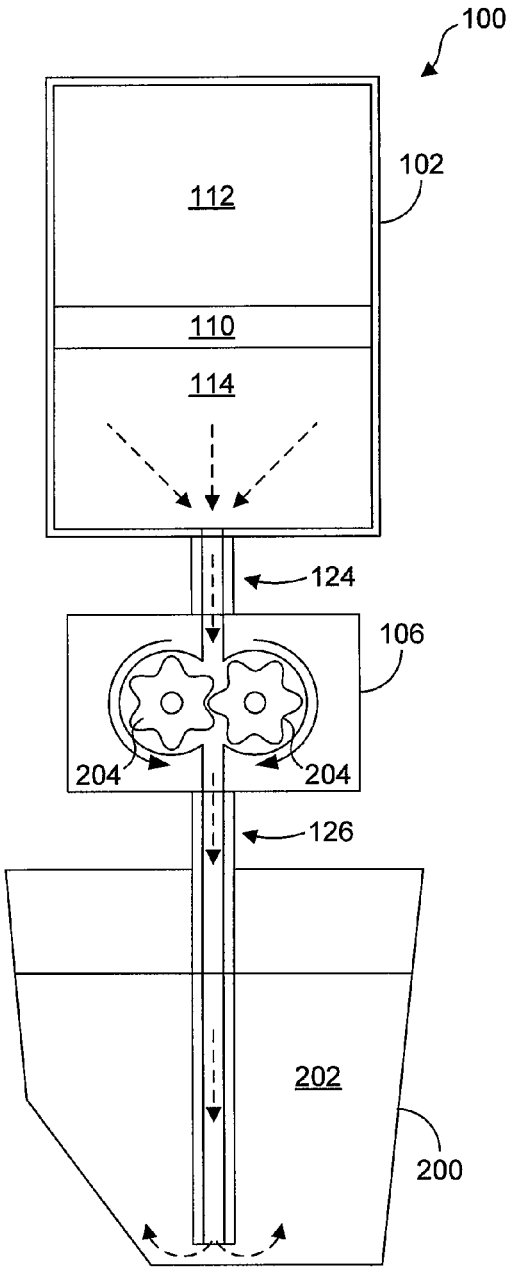
FIGS. 2A and 2B are schematic views of the self-cleaning ink supply system of FIG. 1, respectively depicting normal operation and self-cleaning operation of the system.
Figure 2B:
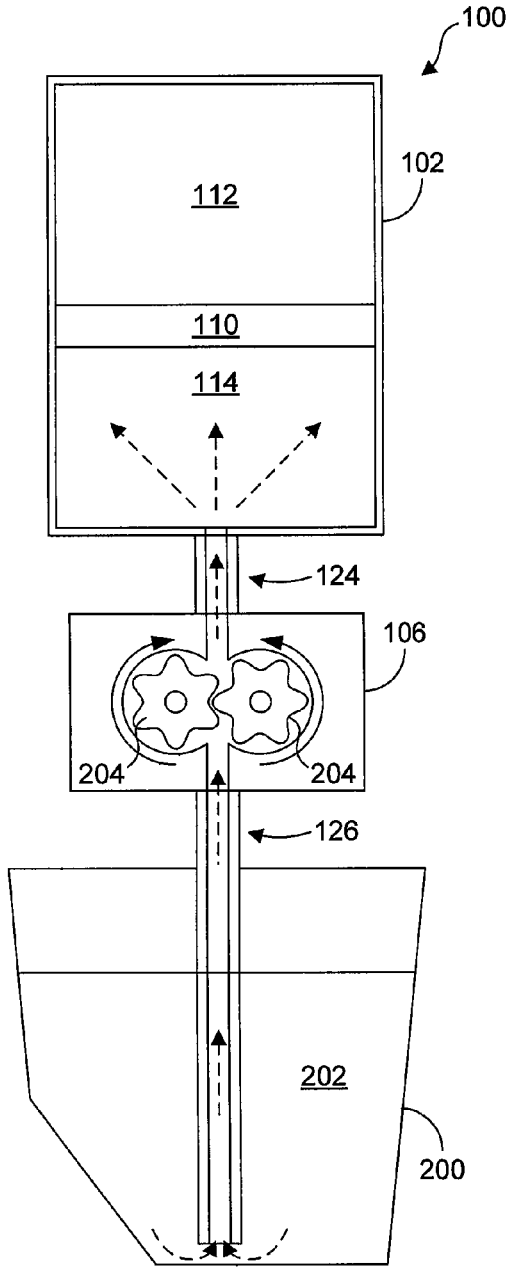

FIGS. 2A and 2B are schematic views of the self-cleaning ink supply system 100 of FIG. 1 and illustrate operation of the system. FIG. 2A illustrates what may be termed "normal" operation of the system 100 in which concentrated ink 114 from the ink reservoir 102 is supplied to an ink tank 200. Like the ink reservoir 102, the ink tank stores ink 202. The ink 202 in the ink tank 200, however, has a lower viscosity given that, in addition to concentrated ink 114 from the ink reservoir 102, the ink tank receives pure oil from an oil supply system (not shown). In some embodiments, the ink 202 in the ink tank 200 has a composition of approximately 98% oil and 2% ink pigment, while the concentrated ink in the ink reservoir 102 has a composition of approximately 80% oil and 20% ink pigment. It is the ink 202 contained within the ink tank 200 that is ultimately provided to the printing mechanism (not shown) for application to a print medium.

Continuing with FIG. 2A, concentrated ink 114 is delivered from the ink reservoir 102 to the ink tank 200 in the directions indicated by the flow arrows through the combined action of the piston 110 and the pump 106. Specifically, the pump 106 draws concentrated ink 114 from the ink reservoir 102 while the piston 110 drives the concentrated ink 114 toward the pump to reduce or avoid the creation of a vacuum. As indicated in FIG. 2A, the pump 106 may comprise a gear pump that includes opposed gears 204 that drive the concentrated ink 114. During normal operation, the gears 204 rotate in a forward direction shown in FIG. 2A to drive concentrated ink 114 toward the ink tank 200. Therefore, when operated in the forward direction, the pump 102 supplies concentrated ink to the ink tank 200.

Turning to FIG. 2B, illustrated is what may be termed "self-cleaning" operation of the ink supply system 100. As is apparent from FIG. 2B, the directions of rotation for the gears 204 have been reversed relative to those shown in FIG. 2A such that the pump 106 drives the concentrated ink 114 (and non-concentrated ink 202) in a rearward or backward direction toward the ink reservoir 102. As described below, such rearward or backward flow of ink serves to clear or prevent clogs within the system 100. In some embodiments, the pump 106 can be operated in the reverse direction depicted in FIG. 2B at the end of each delivery cycle in which concentrated ink is delivered in the forward direction depicted in FIG. 2A.

Figure 3A:
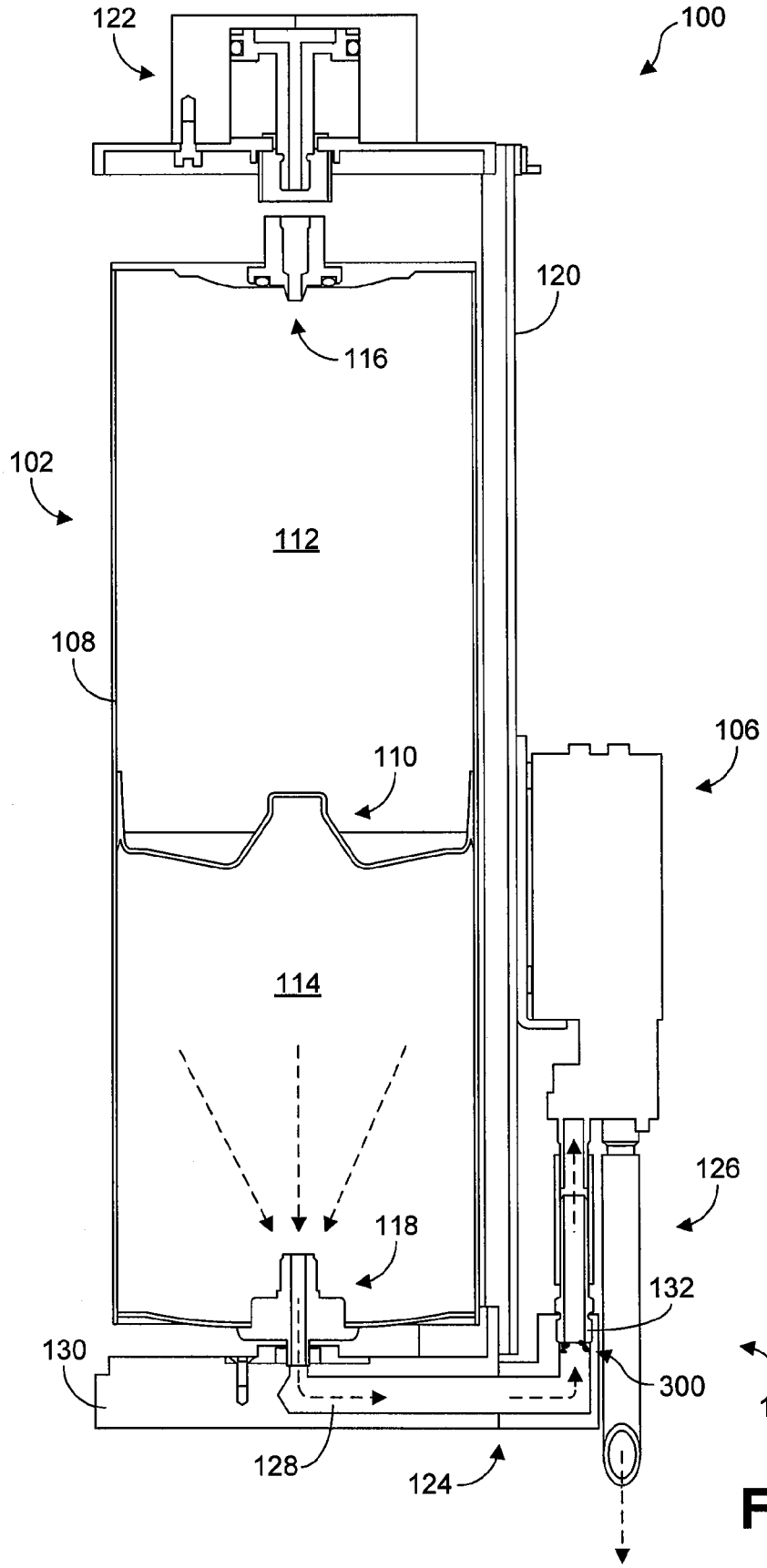
FIGS. 3A and 3B are further side views of the self-cleaning ink supply system of FIG. 1, illustrating performance of self-cleaning to prevent formation of a clog.
Figure 3B:
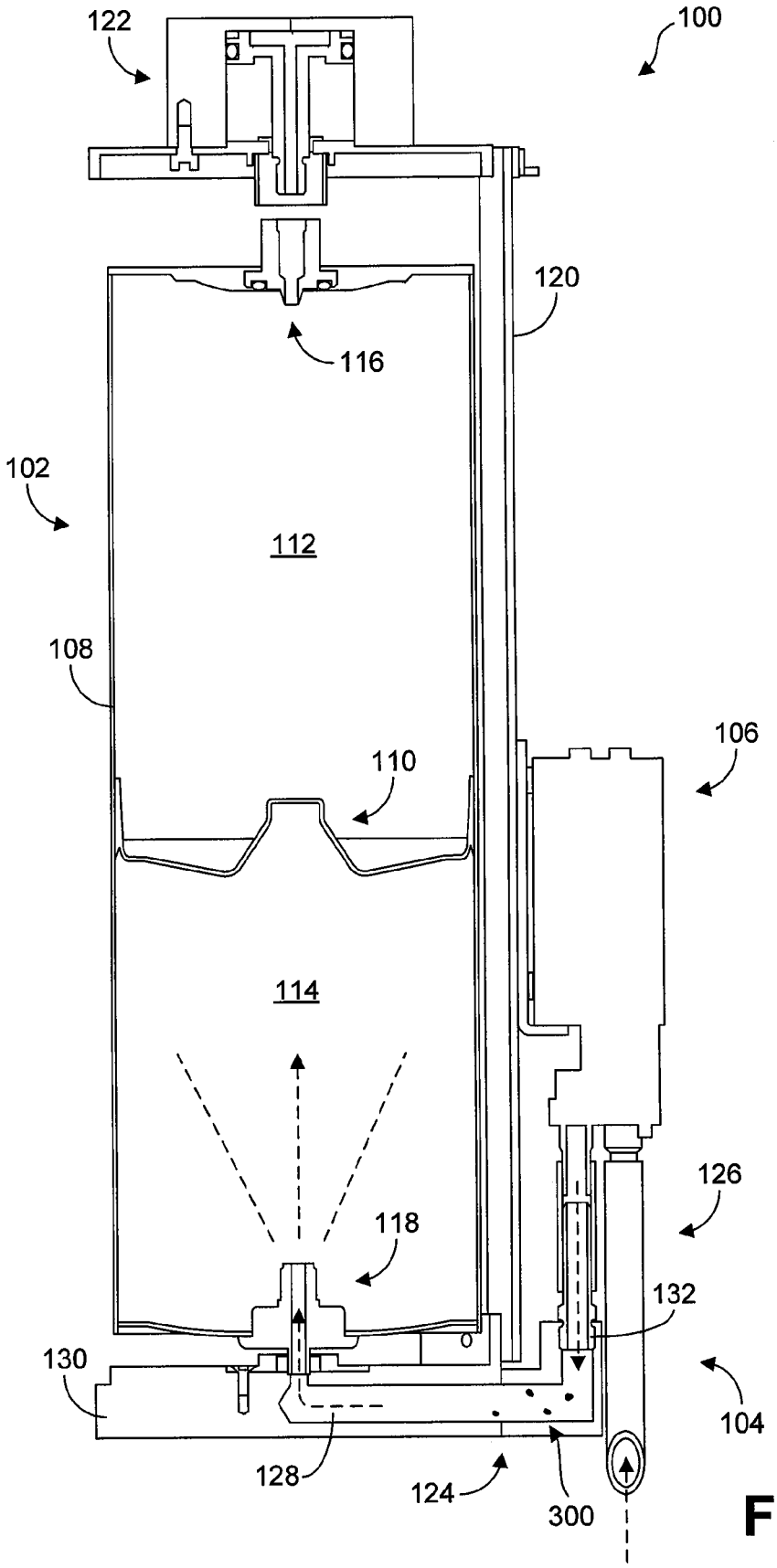

FIGS. 3A and 3B illustrate the normal and self-cleaning operations described above as applied to the ink supply system 100 shown in FIG. 1. Beginning with FIG. 3A, the system 100 is operated in the normal state in which concentrated ink 114 is driven in the forward direction toward the ink outlet 118, through the outlet and into the first section 124 of the system of ink delivery passages 104, into the pump 106, and out from the pump and into the second section 126 of the system of ink delivery passages. As indicated in FIG. 3A, residue 300 comprising particles of ink pigment has accumulated within the first section 124 of the system of passages 104. Specifically, the residue 300 has formed at the interface of the first tube 128 and the second tube 132. If no action were taken, the residue 300 could accumulate further particles of ink pigment and grow until partially or completely obstructing the second tube 132.

With reference to FIG. 3B, such further accumulation is avoided or at least reduced by reversing the direction of flow within the ink supply system 100 such that the residue 300 is dislodged and/or broken apart by the force (e.g., shear stress) of the reversed flow. Therefore, the ink path defined by the ink supply system 100 is cleaned such that concentrated ink can be supplied to the ink tank without interruption and without the need for human intervention.

Notably, when the flow is reversed during the self-cleaning operation, non-concentrated ink from the ink tank may be drawn up by the pump 106 and may traverse the system of passages 104 to the ink reservoir 102. Such action is not considered disadvantageous. To the contrary, because the non-concentrated ink has lower viscosity, it may be more effective at flushing residue from the areas in which it accumulates, such as within the pump and tubes. That said, it is desirable, in at least some embodiments, to avoid or limit the flow of non-concentrated ink into the ink reservoir 102. Entry of non-concentrated ink into the ink reservoir 102 can be prevented or reduced by limiting the duration during which the pump 106 is operated in the reverse direction. For example, through knowledge of the parameters of the ink supply system 100 and the characteristics of the ink, the time required for the pump 106 to deliver non-concentrated ink to the ink outlet 118 can be determined, and operation of the pump in the reverse direction during self-cleaning operation can be limited to that time. In other embodiments, arrival of the non-concentrated ink at the ink port 118 can be directly or indirectly sensed. For example, a current drop of a motor of the pump 106 can be detected, which may be indicative of non-concentrated ink flowing through the pump.

It is also noted that reversal of flow may provide benefits beyond cleaning. In particular, when the pump 106 is reversed, concentrated ink that had been drawn from the ink reservoir 102 is again placed back inside the reservoir. This action increases the pressure within the ink reservoir 102 adjacent the ink outlet 118. This pressure increase can be considered advantageous given that the pressure of the concentrated ink 114 adjacent the ink outlet 118 may drop during ink delivery due to forward operation of the pump 106. In such cases, the oil within the concentrated ink 114 tends to flow toward the area of relatively low pressure, thereby resulting in other areas of the concentrated ink having less oil and drying out.

Figure 4:
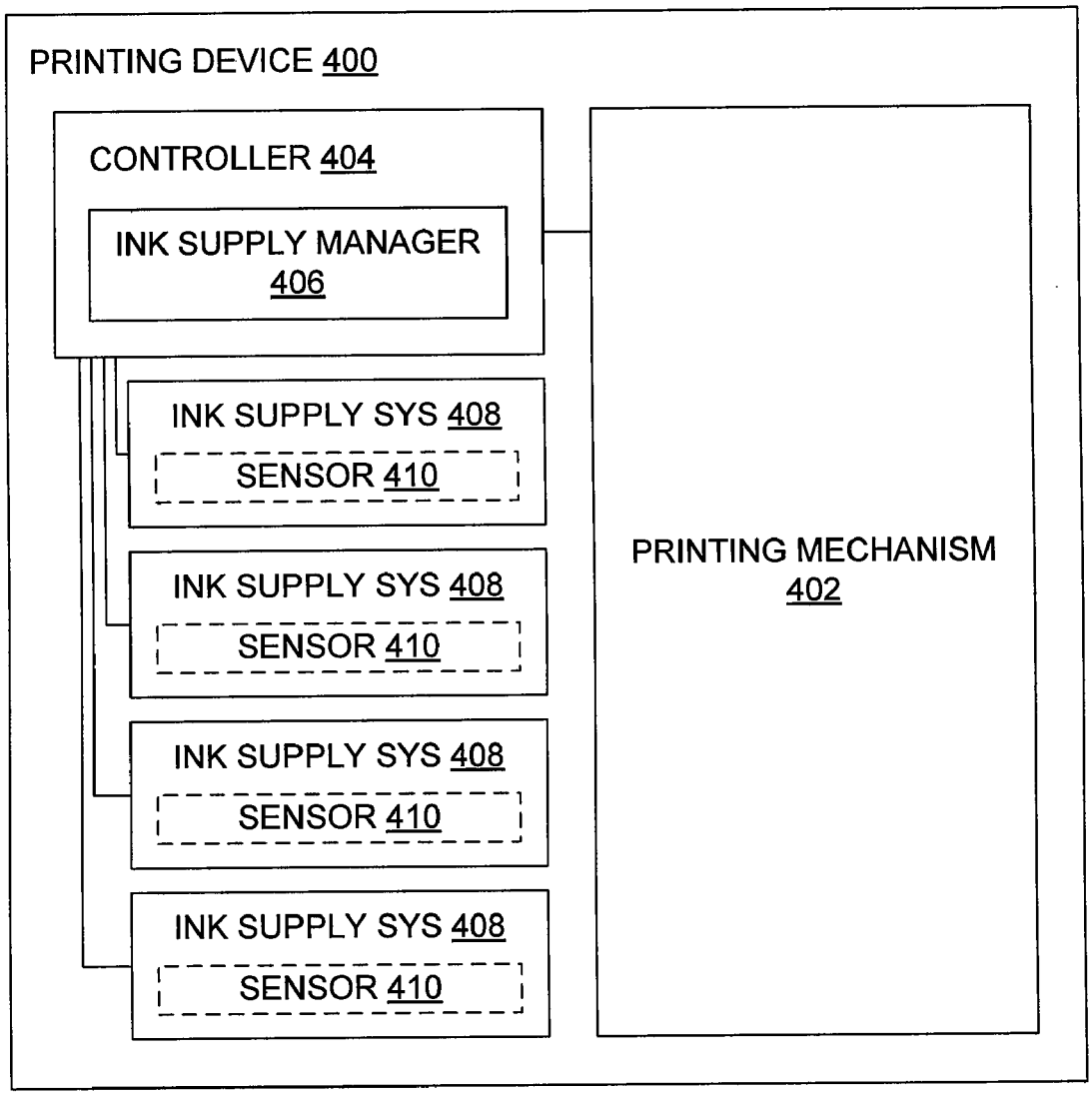
FIG. 4 is a block diagram of an embodiment of a printing system comprising multiple self-cleaning ink supply systems.

With reference next to FIG. 4, illustrated is a block diagram of an example printing device 400. By way of example, the printing device 400 comprises a commercial digital printing press. As indicated in FIG. 4, the printing device 400 comprises a printing mechanism 402 that is used to apply text, graphical, and/or photographic images on print media, such as paper. Operation of the printing mechanism 402 is controlled by a controller 404, which may comprise a processor, memory, and various logic. In addition or exception, the controller 404 can comprise one or more application-specific integrated circuits (ASICs). In some embodiments, the logic includes an ink supply manager 406 that contains instructions for controlling the operation of multiple ink supply systems 408, each of which may be configured in similar manner to the system 100 described above. Although four such systems 408 are shown in FIG. 4, greater or fewer ink supply systems 408 can be used. For example, in some embodiments, seven ink supply systems 408 are used. In some embodiments, each of the ink supply systems 408 supplies a different color of ink to the print mechanism 402. As is further indicated in FIG. 4, each ink supply system 408 optionally includes a sensor 410 that may be used in determining when to cease reverse operation of the pump.

Figure 5:
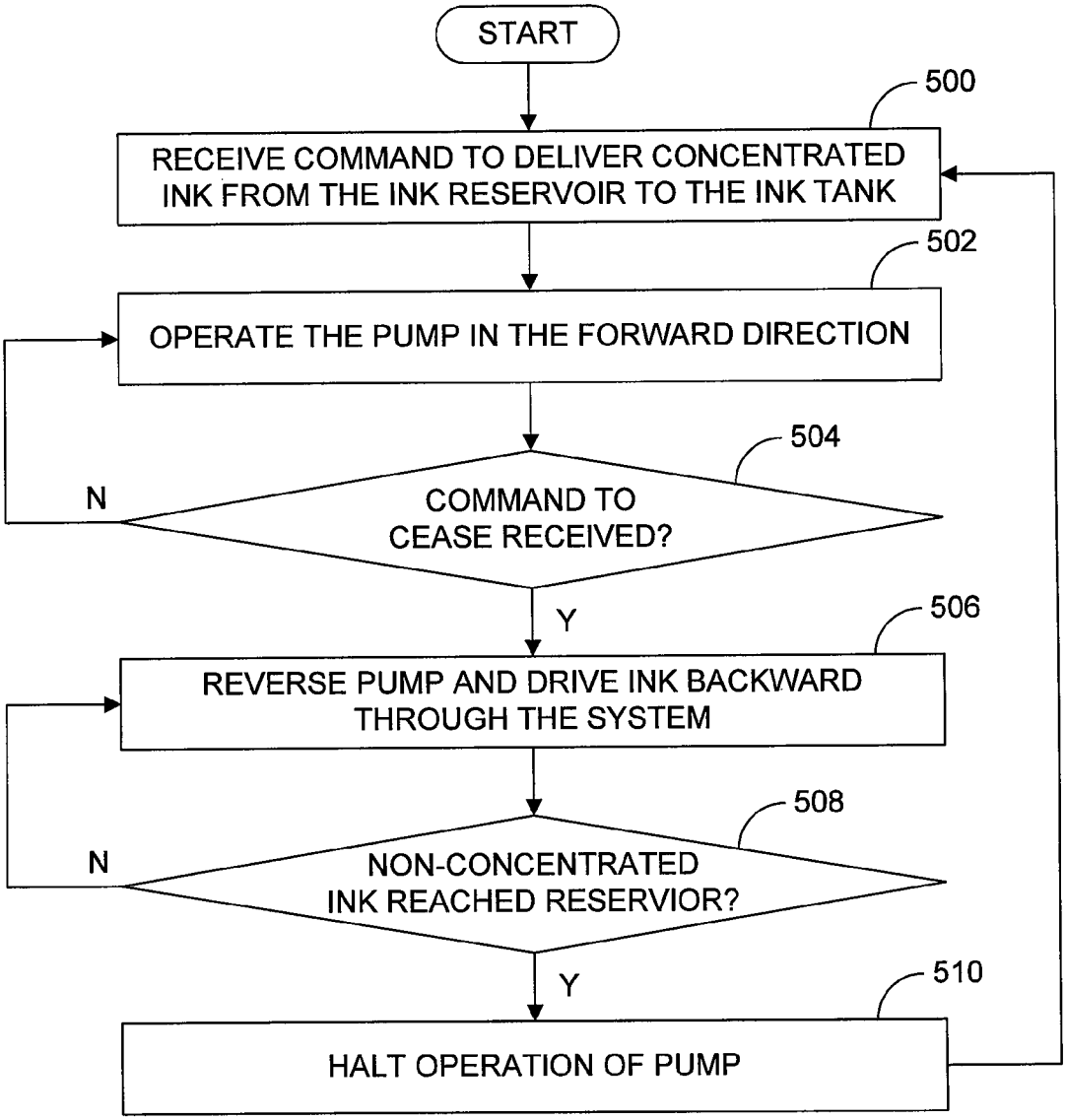
FIG. 5 is a flow diagram of an embodiment of a method for self-cleaning in an ink supply system.

Referring next to FIG. 5, illustrated is a flow diagram of an embodiment of a method for self-cleaning in an ink supply system. Beginning with block 500, the system receives a command to deliver concentrated ink from the ink reservoir to the ink tank. By way of example, such a command can be received when an amount of ink in the ink tank falls to a predetermined level. Next, the system operates the pump in the forward direction, as indicated in block 502, to supply concentrated ink to the ink tank. With reference to decision block 504, it is determined whether a command to cease delivery of concentrated ink has been received. If not, the process returns to block 502 at which the pump continues to be operated in the forward direction. By way of example, the pump may be operated in the forward direction for approximately 0.5 to 30 seconds before a cessation command is received.

If a command to cease delivery is received, the system reverses the pump and drives ink backward through the system, as indicated in block 506. With reference next to decision block 508, operation depends upon whether non-concentrated ink has reached the ink reservoir or not. As described above, various methods can be used to determine how long the pump should be operated in the reverse direction. By way of example, the pump may be operated for approximately 1-3 seconds in the reverse direction.

If the non-concentrated ink has not reached the ink reservoir (as determined through sensing and/or estimation), reverse operation of the pump is maintained. If it has, however, the process continues to block 510 at which the system halts operation of the pump. At this point, the process eventually returns back to block 500 at which a new command to deliver concentrated ink from the ink reservoir to the ink tank is received.

We claim:

1. A method for controlling an ink supply system, the method comprising:

operating a pump of the ink supply system in a forward direction to supply concentrated ink from an ink reservoir to an ink tank, the ink tank containing non-concentrated ink; and subsequent to operating the pump in the forward direction, reversing the pump and operating the pump in a reverse direction to prevent or reduce formation of clogs within the ink supply system.

2. The method of claim 1, wherein supplying concentrated ink from the ink reservoir to the ink tank comprises supplying the concentrated ink through ink delivery passages of the ink supply system.

3. The method of claim 1, wherein operating the pump in the reverse direction comprises driving concentrated ink backward through the ink delivery passages and pump toward the ink reservoir.

4. The method of claim 3, wherein operating the pump in the reverse direction comprises supplying the concentrated ink contained within the ink delivery passages into the ink reservoir.

5. The method of claim 3, wherein operating the pump in the reverse direction further comprises drawing non-concentrated ink from the ink tank and driving the non-concentrated ink backward through the ink delivery passages and pump toward the ink reservoir, wherein the non-concentrated ink has a lower viscosity than the concentrated ink and therefore is more effective at flushing the ink supply system.

6. The method of claim 5, further comprising limiting operation of the pump in the reverse direction to limit the amount of non-concentrated ink that reaches the ink reservoir.

7. The method of claim 6, wherein limiting operation of the pump in the reverse direction comprises limiting operation of the pump in the reverse direction to a predetermined period of time.

8. The method of claim 6, wherein limiting operation of the pump in the reverse direction comprises limiting operation of the pump in the reverse direction relative to a sensed parameter.

9. The method of claim 1, further comprising resuming operation of the pump in the forward direction after operating the pump in the reverse direction to supply further ink from the ink reservoir to the ink tank.

10. A method for cleaning an ink supply system, the method comprising:

operating a pump of the ink supply system in a forward direction to draw concentrated ink from an ink reservoir via a first ink delivery passage and force the concentrated ink through a second ink delivery passage to an ink tank that contains non-concentrated ink;

ceasing operation of the pump in the forward direction once an amount of concentrated ink has been supplied to the ink tank; and after cessation, reversing the pump and operating the pump in a reverse direction to drive concentrated ink backwards through the ink delivery passages and pump toward the ink reservoir and to draw non-concentrated ink from the ink tank into the ink delivery passages and the pump and drive the non-concentrated ink toward the ink reservoir to enable the non-concentrated ink to flush the ink delivery passages and pump to prevent or reduce the formation of clogs within the ink delivery passages and pump.

11. The method of claim 10, wherein operating the pump in the reverse direction comprises supplying the concentrated ink contained within the ink delivery passages and pump back into the ink reservoir.

12. The method of claim 10, further comprising limiting operation of the pump in the reverse direction to limit the amount of non-concentrated ink that reaches the ink reservoir.

13. The method of claim 10, further comprising limiting operation of the pump in the reverse direction to prevent the non-concentrated ink from entering the ink reservoir.

14. A self-cleaning ink supply system, comprising:

an ink reservoir;

a concentrated ink in the ink reservoir;

an ink tank to receive the concentrated ink and dilute the concentrated ink to form a non-concentrated ink; and a reversible pump adapted to alternately operate in a forward direction to draw the concentrated ink from the ink reservoir and supply it to the ink tank and operate in a reverse direction to draw the non-concentrated ink from the ink tank to flush the pump and ink delivery passages of the ink supply system.

15. The ink supply system of claim 14, wherein the ink reservoir comprises a piston that divides an interior space of the reservoir into two portions, one portion for containing pressurized gas and the other portion for containing the concentrated ink.

16. The ink supply system of claim 14, wherein the pump is further adapted to limit operation in the reverse direction to prevent or reduce non-concentrated ink from entering the ink reservoir.

17. The ink supply system of claim 16, wherein the pump comprises a sensor that senses a parameter useful in determining whether the non-concentrated ink has reached the ink reservoir.

18. The ink supply system of claim 14, wherein the pump is a gear pump.

19. A printing device, comprising:

a printing mechanism; and a self-cleaning ink supply system that supplies ink to the printing mechanism, the ink supply system including:

an ink reservoir;

a concentrated ink in the ink reservoir;

an ink tank to receive the concentrated ink and dilute the concentrated ink to form a non-concentrated ink;

and a reversible pump adapted to alternately operate in a forward direction to draw the concentrated ink from the ink reservoir and supply it to the ink tank and operate in a reverse direction to draw the non-concentrated ink from the ink tank to flush the pump and ink delivery passages of the ink supply system.

* * * * *